US005274939A

United States Patent [19]

Scaramucci et al.

[11] Patent Number: 5,274,939

[45] Date of Patent: Jan. 4, 1994

[54] FIRING MECHANISM FOR FIREARMS

[75] Inventors: Sergio Scaramucci, Petriano; Paolo Bellardi, Pesaro, both of Italy

[73] Assignee: Benelli Armi S.p.A., Urbino, Italy

[21] Appl. No.: 815,376

[22] Filed: Dec. 31, 1991

[30] Foreign Application Priority Data

Jan. 10, 1991 [IT] Italy ..... MI91A 00046

[51] Int. Cl.[5] ..... F41A 19/14

[52] U.S. Cl. ..... 42/69.03; 89/154; 89/27.11

[58] Field of Search ..... 42/69.03; 89/139, 140, 89/141, 142, 146, 132, 154, 27.11

[56] References Cited

U.S. PATENT DOCUMENTS

| | | | |
|---|---|---|---|
| 639,421 | 12/1989 | Mauser | 42/69.03 |
| 935,237 | 9/1909 | Savage | 42/69.03 |
| 939,882 | 11/1909 | Whiting | 42/69.03 |
| 1,202,017 | 10/1916 | Barnes | 42/69.03 |
| 1,892,141 | 12/1932 | Garand | 42/69.03 |
| 2,189,202 | 2/1940 | Garland | 89/139 |
| 2,675,638 | 4/1954 | Crittendon | 89/146 |
| 2,855,716 | 10/1958 | Campbell | 42/69.03 |
| 2,901,853 | 9/1959 | Fontvieille | 42/69.03 |
| 3,203,128 | 8/1965 | Friend | 42/69.03 |
| 4,017,996 | 4/1977 | Liedke | 42/69.03 |

FOREIGN PATENT DOCUMENTS

| | | | |
|---|---|---|---|
| 299873 | 8/1932 | Italy | 89/132 |
| 1410023 | 10/1975 | United Kingdom | 42/69.03 |

*Primary Examiner*—Stephen M. Johnson

*Attorney, Agent, or Firm*—Amster, Rothstein & Ebenstein

[57] ABSTRACT

Firing mechanism for firearms, including a hammer which is actuated by a spring and rotates about a pivot, defining a cocked position and a percussion position; the spring acts directly on the hammer on a surface point which defines a lever arm with the pivot of the hammer, so that the lever arm is variable as the hammer moves between the cocked and percussion positions.

6 Claims, 4 Drawing Sheets

FIRING MECHANISM FOR FIREARMS

The present invention relates to a firing mechanism for firearms.

BACKGROUND OF THE INVENTION

The firing mechanism of a firearm is generally constituted by a hammer which rotates about a pivot and is actuated by a spring.

One end of the hammer is provided with a hammer dog which is adapted to engage an associated trigger dog of the trigger, so that a rotation of the trigger leads to the disengagement of the hammer, which, being actuated by the spring, acts on the percussion pin.

In the firing action there are two critical moments in the action of the spring on the hamme: the first critical moment is the percussion step, during which the spring should preferably act with the maximum possible force on the hammer; the second critical moment is the hammer cocking step, which naturally must encounter the least possible resistance, especially in the case of automatic or semiautomatic firearms.

In known firing mechanisms, the spring is generally in the maximum compression position in the cocking step, whereas in the percussion step it is in its maximum extension position; in this manner it is apparent that the spring exerts excessive resistance during the cocking step, while not all the possible force is exerted on the hammer during the percussion step.

A few attempts to solve this problem have been made, at the cost of an excessively complex construction, however. It would be in fact easy to design a mechanism, with the desired characteristics, comprising several levers; such mechanism, however, would be too expensive and unreliable, as well as heavy and cumbersome.

A simpler design has been proposed in U.S. Pat. No. 4,693,027 which discloses a flat gun spring, for handguns. The spring has a progressively decreasing depth that permits more energy to be stored in the spring during the early stages of the hammer rotation and less energy in the later stages of the hammer rotation. This design substantially aims at eliminating "stack up" immediately prior to hammer release.

SUMMARY OF THE INVENTION

The aim of the present invention is to provide a firing mechanism in which the force exerted by the spring during the percussion step is increased, while the resistance opposed during the cocking step is decreased.

Within the scope of this aim, an object of the invention is to provide a constructively simple mechanism without the addition of further levers or other elements to the mechanism.

This aim, this object and others which will become apparent hereinafter are achieved by a firing mechanism for firearms, comprising a hammer and a resilient member, said hammer rotating about a pivot and having a cocking position and a percussion position, wherein said resilient member acts directly on a point of a surface of said hammer, said point defining a lever arm with said hammer pivot, said lever arm being variable as said hammer moves between said cocking position and said percussion position.

BRIEF DESCRIPTION OF THE DRAWINGS

Further characteristics and advantages will become apparent from the description of a preferred but not exclusive embodiment of the invention, illustrated only by way of non-limitative example in the accompanying drawings, wherein.

DETAILED DESCRIPTION OF THE INVENTION

Figure 1:
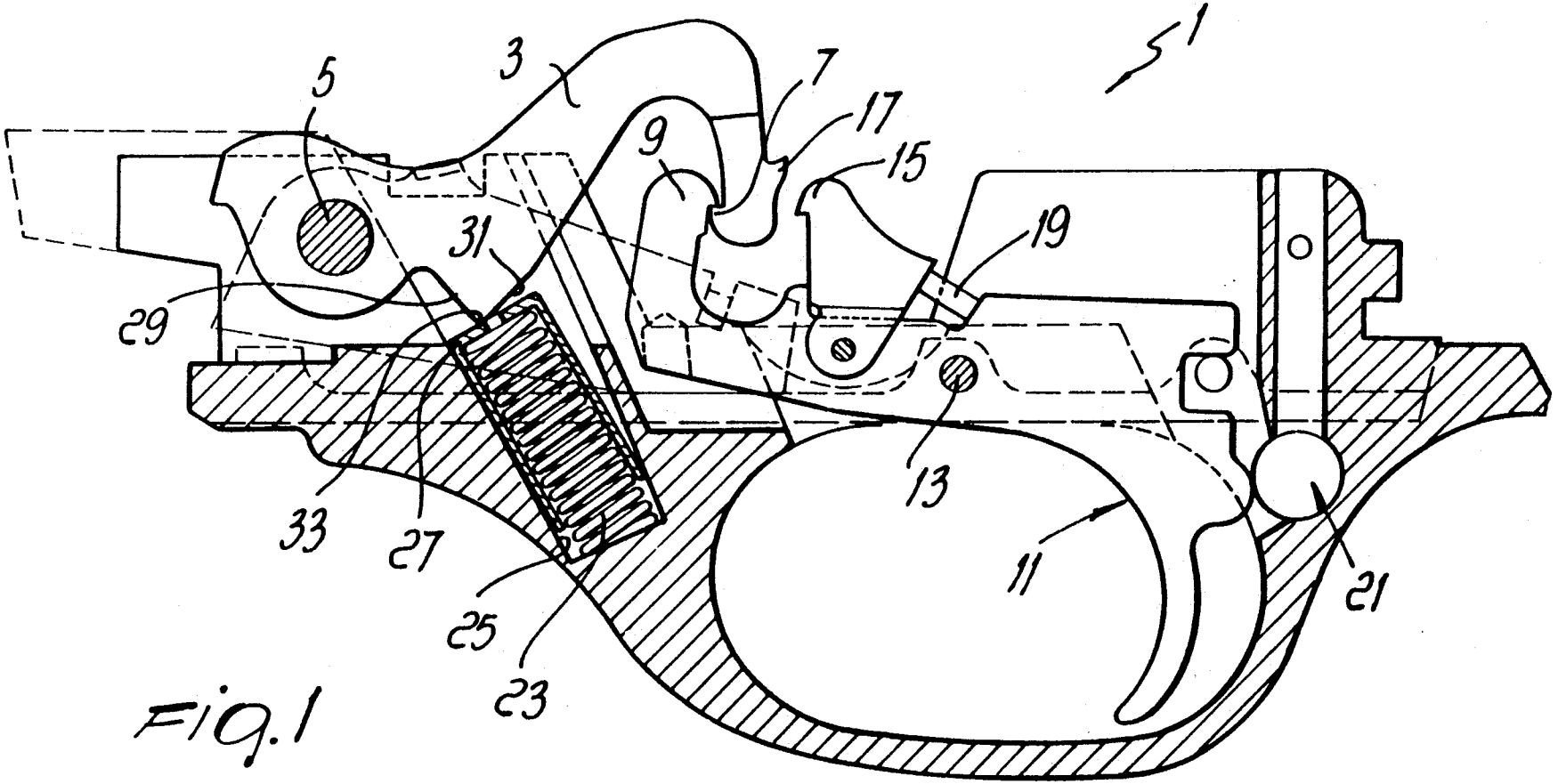
FIG. 1 is a sectional side view of a firing mechanism according to the invention in the disengagement step.

With reference to the above figures, the firing mechanism according to the invention, generally indicated by the reference numeral 1, comprises a hammer 3, which is pivoted to a pivot 5, and has a hammer dog 7. Hammer dog 7 is adapted to engage a trigger dog 9 of a trigger 11.

Trigger 11 is pivoted to a pivot 13 and has a second trigger dog 15 which is adapted to engage a second hammer dog 17 of the hammer. Second trigger dog 15 is pivoted to trigger 11 and can perform a slight backward movement in contrast with a resilient member 19.

The firing mechanism is also provided with a safety-catch device 21, which is per se known and therefore will not be described herein for the sake of brevity.

According to the invention, a resilient member, constituted by a spring 23, is arranged in a conical seat 25 in the body of the firearm. The upper end of spring 23 is inserted in a cup 27.

Under the action of spring 23, cup 27 acts on a first action surface 29 and on a second action surface 31 of the hammer 3. Action surfaces 29 and 31 are connected by a corner surface 33 and are arranged at a certain angle with one another.

The operation of the firing mechanism according to the invention is as follows.

In FIG. 1, the mechanism is illustrated in the disengagement step, i.e. when the trigger is pulled in order to fire; in this step, spring 23 is subjected to maximum compression and is arranged with such an inclination that cup 27 acts on the hammer substantially at the surface 31 of the hammer.

Figure 2:
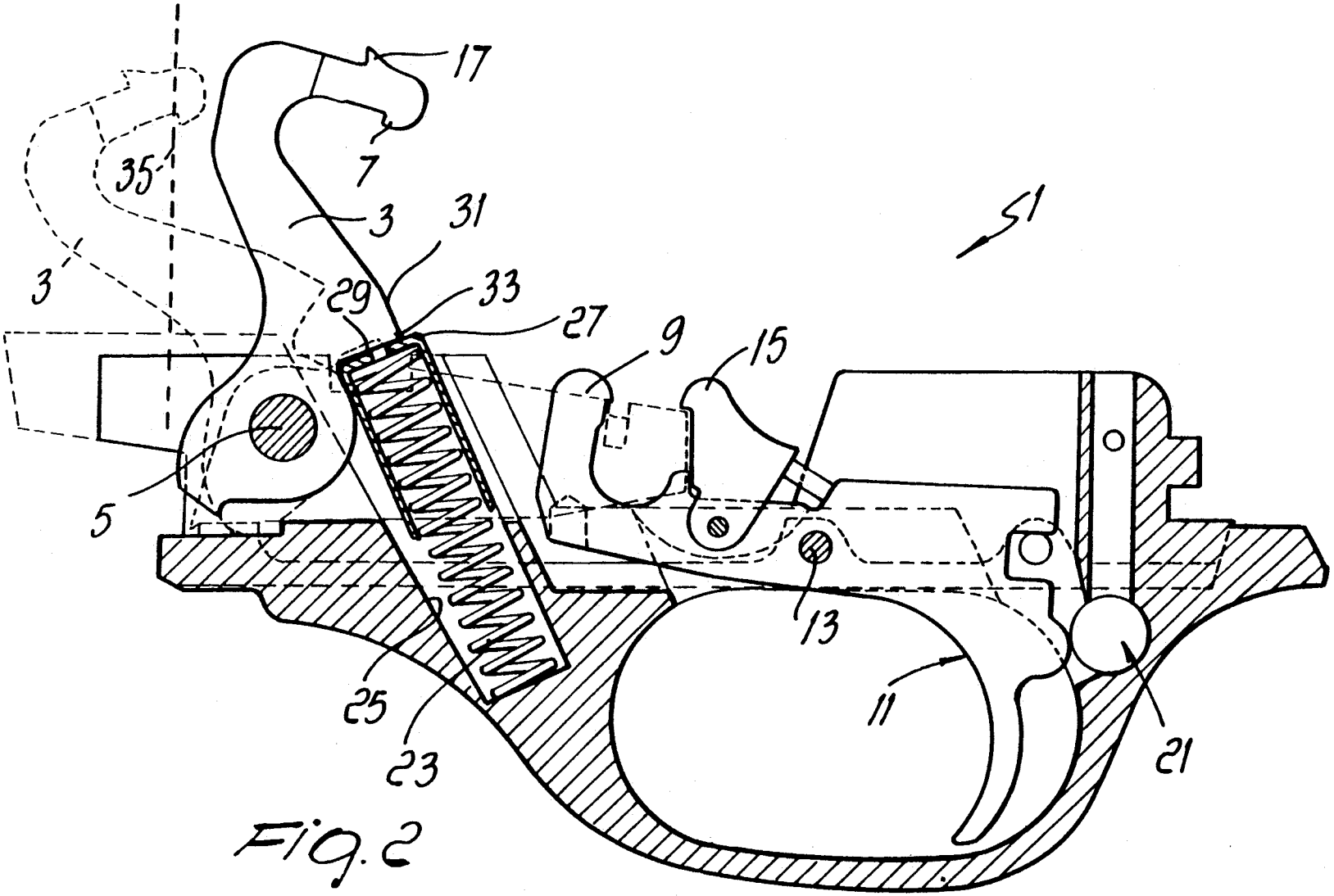
FIG. 2 is a sectional side view of the mechanism of FIG. 1 during the percussion step.

FIG. 2 illustrates the percussion step, and in particular the broken line 35 indicates the percussion plane; in this step, spring 23 is at its maximum extension position and the cup 27 acts on the hammer substantially on the action surface 29. This is due to the conical configuration of the seat 25, which allows the spring 23 to rotate backward through a set angle.

Figure 3:
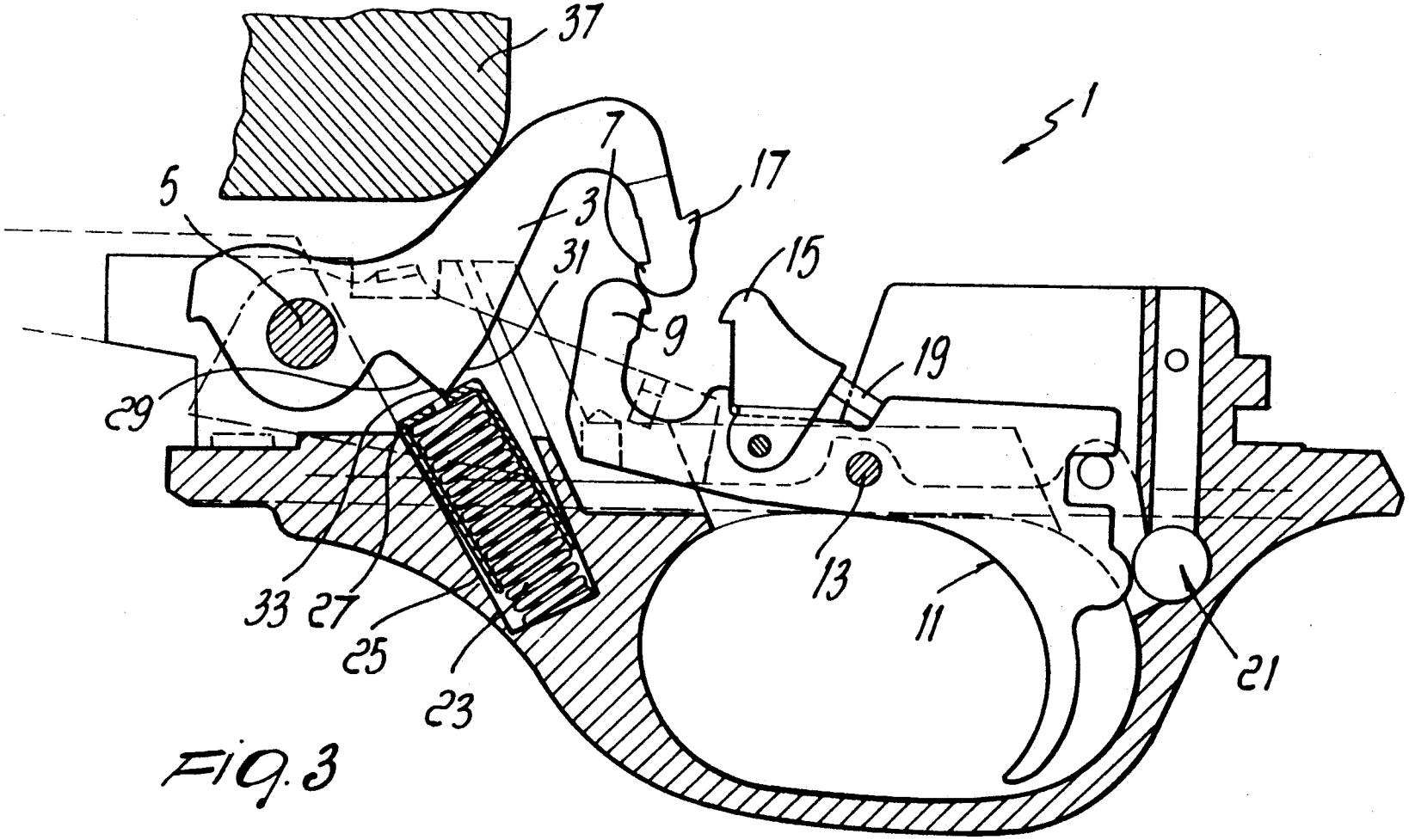
FIG. 3 is a sectional side view of the mechanism of FIG. 1 during the opening step.
Figure 4:
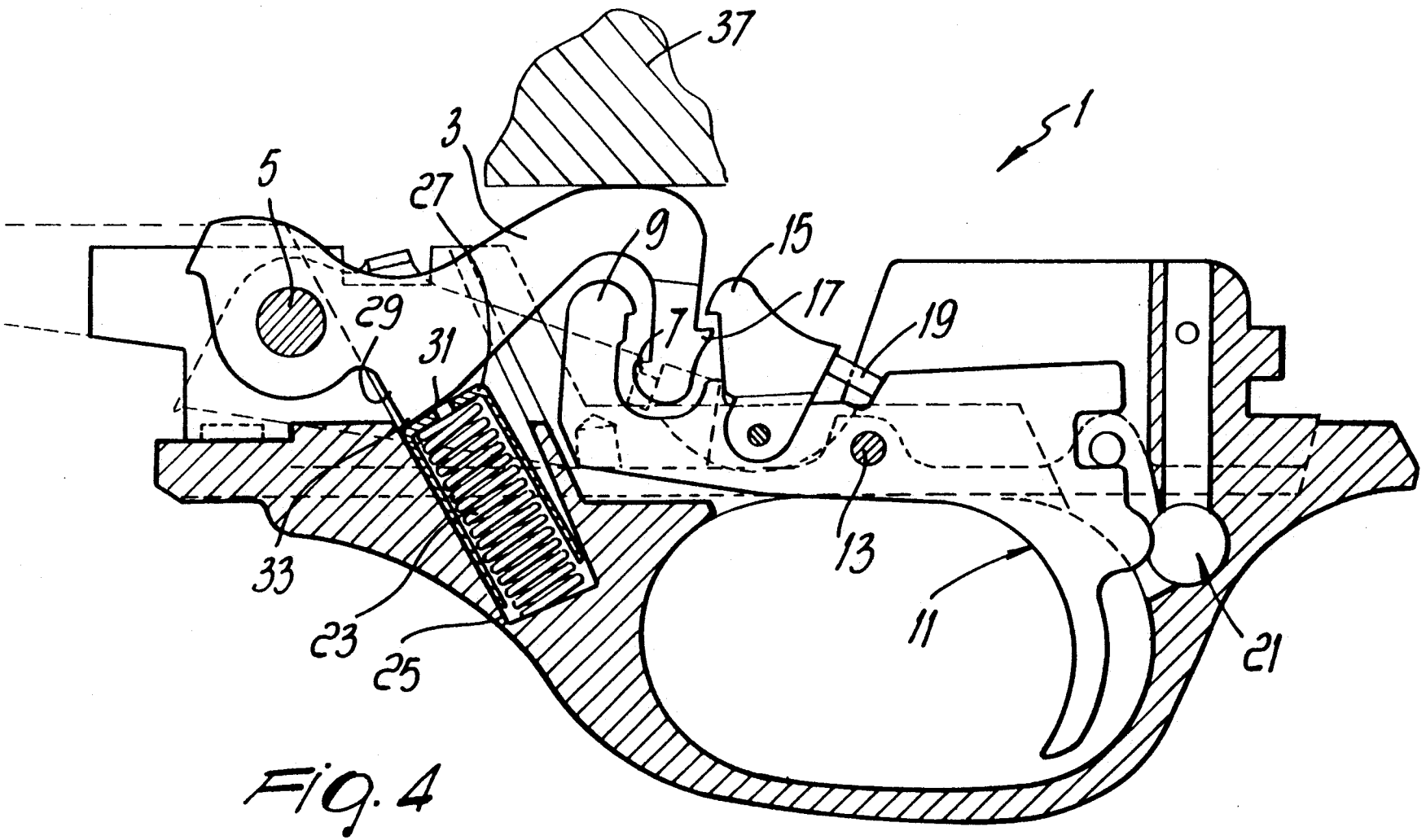
FIG. 4 is a sectional side view of the mechanism of FIG. 1 during the engagement step.

FIG. 3 illustrates the subsequent step of the opening of the bolt 37 which, by sliding backward, acts on the hammer 3 and cocks it. It is in fact apparent from FIG. 3 that the point of action of the cup 27 shifts from the surface 29 to the corner surface 33 and then to the surface 31 in the subsequent engagement step, which is illustrated in FIG. 4.

In the engagement step, the hammer slides against the lower part of bolt 37, which transmits the minimum amount of energy to the hammer. In this step, the compression of the spring is maximum. FIG. 4 furthermore clearly shows that the second stop tooth 15 of the trigger engages the second tooth 17 of the hammer to prevent the subsequent actuation of the firing mechanism by keeping the trigger pulled. It is therefore necessary to release the trigger and pull it again in order to actuate the mechanism a second time.

It has been observed in practice that the invention achieves the intended aim and objects, a firing mechanism having been provided in which the lever arm, defined between the direction of the thrust of the hammer spring and the hammer's rotation pivot, is varied.

This variation is obtained by changing the direction of the spring's thrust and therefore the distance of its vector from the hammer pivot, so as to obtain a desired variation of the hammer cocking effort and of the hammer's pressure on the lower part of the bolt during its sliding, without compromising the thrust on the hammer during the percussion step.

The variation in the vectorial direction of the hammer spring's thrust is obtained without levers or the addition of parts, but simply by allowing the guiding cup of the spring to move within the conical seat under the action of the thrust of the hammer and of the movement of the point of contact between the cup and said hammer, which is obtained by means of the peculiar shape given to the surface of contact between the hammer and the cup.

Another advantage of the firing mechanism according to the invention is constituted by the limited load on the trigger during disengagement.

The firing mechanism according to the invention is susceptible to numerous modifications and variations, all of which are within the scope of the inventive concept; all the details may furthermore be replaced with technically equivalent elements.

The materials employed, as well as the dimensions, may naturally be any according to the requirements and the state of the art.

We claim:

1. Firing mechanism for firearms, comprising a hammer and a resilient member, said hammer rotating about a pivot and having a cocking position and a percussion position, said hammer comprising a first action surface and a second action surface, said first action surface being connected to said second action surface through a corner surface, said first and second action surfaces being arranged at an angle with respect to one another, said resilient member acting directly on a point of one of said surfaces of said hammer, said resilient member having an axis, said axis being adapted to tilt from a forward position to a rear position as said hammer moves between said cocking position and said percussion position; said resilient member comprising a cylindrical helical spring, said spring having at least one end arranged in a conical seat defined in said firearm, said spring also having a second end acting on said point of said hammer and said second end of said spring being inserted in a cup, said cup being adapted to slide on said surface of said hammer during the movement of said hammer between said percussion and cocking positions.

2. Mechanism according to claim 1, wherein said angle between said action surfaces is approximately equal to 90°.

3. Firing mechanism for firearms, comprising a hammer and a resilient member, said hammer rotating about a pivot and having a cocking position and a percussion position, said hammer comprising a first action surface and a second action surface, said first action surface being connected to said second action surface through a corner surface, said first and second action surfaces being arranged at an angle with respect to one another, said resilient member comprising a cylindrical helical spring, said spring being at least partially inserted into a cup, said cup being adapted to slide on said surfaces of said hammer, said spring being inserted in a seat, said seat being substantially conical allowing for a tilting motion of said spring as said hammer moves between said cocking position and said percussion position.

4. Mechanism according to claim 3, wherein said said hammer defines a point and said spring has at least one end arranged in said seat and has a second end acting on said point of said hammer.

5. Mechanism according to claim 4, wherein said second end of said spring is inserted in said cup, said cup being adapted to slide on said surface of said hammer during the movement of said hammer between said percussion and cocking positions.

6. Mechanism according to claim 3, wherein said angle between said action surfaces is approximately equal to 90°.

* * * * *